United States Patent [19]

Brown et al.

[11] 4,354,599

[45] Oct. 19, 1982

[54] KEG SADDLE

[76] Inventors: Donald L. Brown, 326 N. 38th Pl.; Gareld D. Calvert, 4094 Jasper Rd., both of Springfield, Oreg. 97477

[21] Appl. No.: 184,333

[22] Filed: Sep. 5, 1980

[51] Int. Cl.[3] ..... B65D 21/02

[52] U.S. Cl. ..... 206/503; 108/53.1; 206/821

[58] Field of Search ..... 206/503, 508, 821; 211/74; 108/53.1, 53.3, 53.5

[56] References Cited

U.S. PATENT DOCUMENTS

| | | | |
|---|---|---|---|
| 2,989,177 | 6/1961 | Swick | 206/150 |
| 3,636,888 | 1/1972 | Angelbeck | 108/53.1 |
| 3,747,780 | 7/1973 | Schneider | 108/53.1 |

*Primary Examiner*—George E. Lowrance
*Attorney, Agent, or Firm*—Harvey B. Jacobson

[57] ABSTRACT

A pallet or saddle used for the storage and transporting of containers such as beer kegs and the like is structured so as to allow the storage and transportation of two beer kegs, in which the saddle is placed over an upright bottom keg and a second keg is laid sideways across the top portion of the saddle. The saddle comprises a circular disk containing a concave bottom portion to fit over the top of an upright beer keg and a top portion which comprises a pair of parallel spaced shoulders extending across the disk, the spaced shoulders supporting a keg placed sideways therebetween on the top surface of the saddle.

5 Claims, 3 Drawing Figures

KEG SADDLE

BACKGROUND OF THE INVENTION

Field of the Invention

The present invention relates to drum-supporting structures and in particular to the type of structure which has been used for supporting beer kegs.

More particularly, the present invention relates to a pallet or keg saddle which is capable of supporting two beer kegs for storage or transport. The pallet or saddle is formed from a molded impact resistant plastic.

Draft beer is marketed by brewers and distributors in generally cylindrical kegs of different sizes containing different quantities of beer. In the past, the different size of beer kegs have been handled or transported on conventional pallets which are specifically suited for the size of keg which is being transported. Such pallets have been designed to hold four and even five beer kegs at once. Sometimes, however, it is desirable to only transport two kegs at a single time such as for small deliveries or for transport by individuals who have purchased such kegs. The use of the large pallets being, of course, very cumbersome and as such are not suited for such a purpose. Recently, the distributors of beer kegs have modified the shape of the kegs and due to that change, the kegs cannot be conveniently stacked or handled two at once by existing pallets. A need, therefore, exists for a pallet or a keg saddle which can conveniently hold for storage or transportation two kegs at once.

DISCLOSURE STATEMENT

As mentioned above, pallets for the storage and handling of beer kegs are known, primarily structured to hold four or more kegs. Recently, beer keg pallets formed from plastic materials have been patented as a replacement for heavy wooden pallets. In each case, the beer kegs have been supported in a single orientation, that is with each keg standing on one end such as disclosed in U.S. Pat. Nos. 3,995,749, issued Dec. 7, 1976; 3,636,888, issued Jan. 25, 1972 and 3,173,574, issued Mar. 16, 1965, or have been formed so as to support a plurality of kegs in which the kegs are laying sideways across the pallet as disclosed in U.S. Pat. Nos. 3,747,780, issued July 24, 1973, and 3,753,407, issued Aug. 21, 1973. None of these patents, however, discloses a keg saddle such as the one of the present invention in which two kegs of the type presently being used can be stored one on top of each oter in which the bottom keg is upright and the top keg is supported on its side across the top of the bottom keg for the convenient and safe handling of two kegs.

SUMMARY OF THE INVENTION

In accordance with the present invention, a beer keg pallet or keg saddle is provided which is able to support two kegs of beer, one on top of the other in a manner unlike previous pallets.

Briefly, the keg saddle of the present invention comprises a circular disk, preferably made from a high impact resistant plastic and which includes a concave bottom portion which is formed to rest atop an upright beer keg and a top portion which includes a pair of spaced shoulders which support a second keg therebetween in which the second keg is laid on its side. Each of the shoulders extends across the full width of the saddle and include slanting walls to provide increased support for the round keg body preventing the keg from rolling and possibly falling from the saddle.

Accordingly, it is an object of the present invention to provide a pallet for the storage and transportion of large containers and similar structures.

It is another object of the present invention to provide a beer keg pallet or saddle which is able to support for storage and transportation a pair of beer kegs in which the keg saddle supports the kegs one on top of the other.

It is still another object of the present invention to provide a beer keg saddle which is formed of a durable lightweight plastic having high impact resistance and which is able to support beer kegs one on top of the other for convenient and safe storage and transportation.

These together with other objects and advantages which will become subsequently apparent reside in the details of construction and operation as more fully hereinafter described and claimed, reference being had to the accompanying drawings forming a part thereof, wherein like numerals refer to like parts throughout.

DETAILED DESCRIPTION OF THE DRAWINGS

Figure 3:
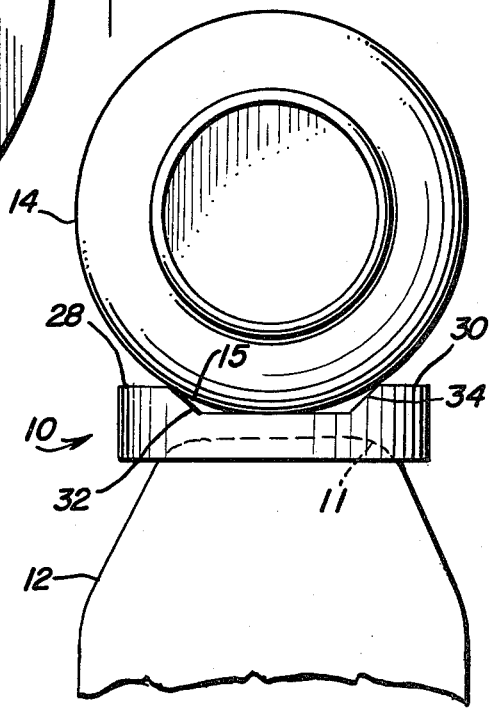
FIG. 3 is a fragmentary elevational view of two kegs of beer being supported by the beer keg saddle of the present invention.

Referring to the drawings, the beer keg pallet or saddle of the present invention is generally indicated by reference numeral 10. While throughout the description of the invention keg saddle 10 will be described for the purpose of supporting beer kegs, it is assumed that the keg saddle can be used for supporting other types of cylindrical containers such as kegs particularly configured as what are commonly known as a Firestone Keg. Keg saddle 10 is preferably made from a lightweight but durable and high impact resistant plastic. Any plastic having the desired properties and which can be molded or otherwise formed into the structure shown in the Figures can be utilized. As illustrated in FIG. 3, keg saddle 10 rests on top 11 of an upright keg 12 and supports keg 14 placed across keg saddle 10 on one side 15. Beer keg 12 can stand on any flat supporting structure such as a warehouse floor or a handheld carrying device for use in transporting objects too heavy to lift by hand. Keg saddle 10 is preferably a circular disk having an upper surface 16 for supporting a keg placed on its side and a bottom surface 18 which is seated on the top of an upright standing keg. An aperture 20 can be placed through the center of keg saddle 10 for eliminating excess weight and for providing a convenient structure for handling saddle 10.

Figure 1:
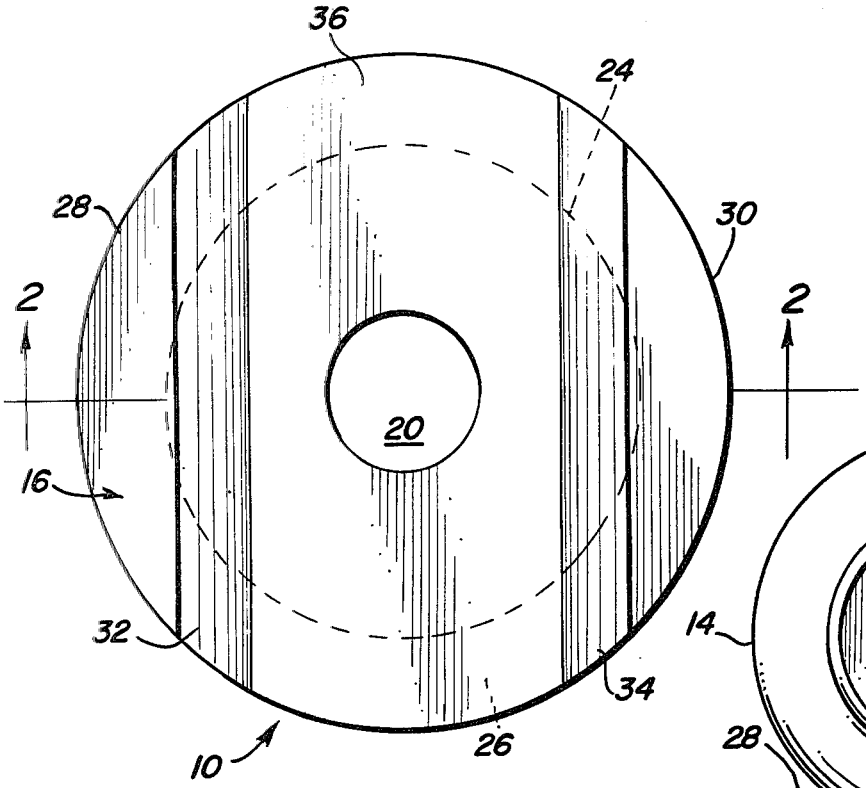
FIG. 1 is a top plan view of the beer keg saddle of the present invention.
Figure 2:
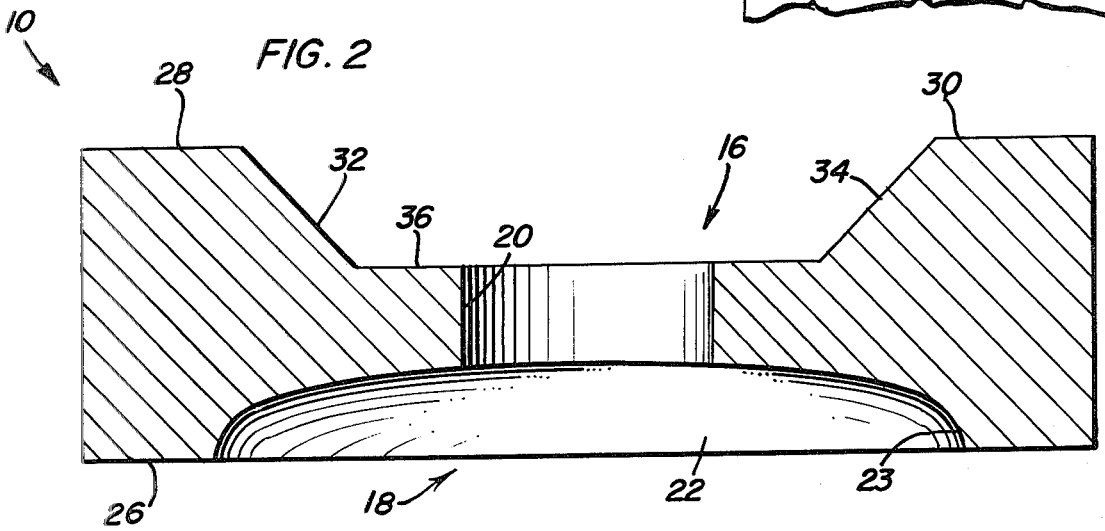
FIG. 2 is a transverse sectional view of the beer keg saddle of the present invention taken generally along the line 2—2 of FIG. 1.

Bottom surface 18 of saddle 10 includes circular concave surface 22 which is contoured to rest or be seated snugly about the top of a beer keg as illustrated in FIG. 3 in which keg saddle 10 rests on top 11 of keg 12. Concave surface 22 is circular to match the shape of top 11 of keg 12 and preferably has a diameter less than the full diameter of saddle 10. The outer circumstance of concave surface 22 is indicated by the dotted line 24 in FIG. 1. Surface 26 extending between concave surface 22 and the outer perimeter of saddle 10 is a flat ring surrounding concave surface 22 and forms the remaining portion of bottom surface 18. Surface 26 provides rigidity to saddle 10 and support for the keg supporting structure contained on upper surface 16. Upper surface 16 supports a keg placed on its side as illustrated by beer keg 14 placed on side 15 in FIG. 3. As illustrated in FIG. 2, upper surface 16 includes a pair of upstanding shoulders 28 and 30 which are spaced to allow a keg to rest therebetween. Slanted walls 32 and 34 contact the rounded body portion of keg 14 resting on flat surface 36 which is in the form of a valley between shoulders 28 and 30. The angle of walls 32 and 34 are such that the rounded shape of a keg body can be accommodated on upper surface 16, the angle providing stability for the keg as it rests on upper surface 16. Shoulders 28 and 30 and respective walls 32 and 34 traverse the entire width of keg saddle 10 as illustrated in FIG. 1 and thereby support a major portion of the body of a keg resting upon upper surface 16. Keg saddle 10 of the present invention can be easily molded into a lightweight one piece construction containing all the features of upper surface 16 and bottom surface 18.

To store or transport two kegs with the use of keg saddle 10, a bottom keg such as keg 12 is placed on a flat surface such as a warehouse floor or movable hand truck and keg saddle 10 is then placed over the top of keg 12 with concave surface 22 being firmly seated so that substantially the major portion of concave surface 22 contacts the outer top surface 11 of the keg. In particular, outer rim 23 of concave surface 22 should be in contact with keg 12. A second keg, keg 14, is placed sideways along upper surface 16 so that a large portion of side 15 of the keg contacts flat surface 36 and walls 32 and 34 to prevent the keg from rolling.

The dimensions of keg saddle 10 can be varied to accommodate kegs of different sizes, but several features must be met to provide a pallet or saddle which can be used conveniently and safely. The radius of concave surface 22 should be such that when keg saddle 10 is seated upon the upper surface of a keg, the entire top surface of the keg should be enclosed thereby. Preferably, the entire area of concave surface 22, including outer rim 23 should be in contact with the upper surface of a keg, avoiding a situation in which concave surface 22 is exceedingly large and does not rest snugly upon the top of the upright keg. Walls 32 and 34 on upper surface 16 are preferably at an angle of at least 45 degrees from a plane parallel with surface 36. The amount of the angle is important as walls 32 and 34 of shoulders 28 and 30, respectively, prevent the upper keg from rolling off keg saddle 10 which besides possible damage to the contents inside the keg could injure the one who is handling the kegs or others in the vicinity thereof. The vertical height of walls 32 and 34 should also be large enough to firmly support a keg between shoulders 28 and 30.

While keg saddle 10 is illustrated as supporting two kegs, one on top of the other, it is clear that keg saddle 10 can be made longer to include a plurality of upper and bottom surfaces 16 and 18, respectively. Such a saddle would primarily be used for storage purposes.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A saddle adapted to hold and restrain two cylindrical objects such as beer kegs, one on top of the other and comprising; a generally cylindrically shaped saddle having the axis extending generally vertically through the saddle, a lower circular and concave surface of the saddle disposed symmetrically about the axis thereof, a portion of said lower surface including means to contact a small portion of the circumferential side edge of said upright keg adjacent the top and the lower surface adapted to be seated on the top surface of an upright keg, and an upper angulated surface of the saddle disposed symmetrically about a diameter thereof, said upper angulated surface including a pair of spaced shoulders extending outwardly of the angulated surface and defining side walls which contact generally tangentially the side walls of the keg on opposite sides of the keg center, said shoulders and side walls extending substantially the full dimensional width of the saddle and adapted to hold a keg oriented on its side and prevent said side oriented keg from excessive rolling.

2. The keg saddle of claim 1 wherein said slanted walls are provided with an angle of about 45°.

3. The keg saddle of claim 1 wherein the upright keg and side oriented keg each are a Firestone keg.

4. The keg saddle of claim 1 wherein the saddle has a centrally disposed opening coaxial with the peripheral cylindrical shape providing for reduction in weight of the saddle together with providing a convenient handling means therefor.

5. The keg saddle of claim 1 wherein the saddle is constructed of a lightweight, but durable, molded and high impact resistant plastic.

* * * * *